US009918161B1

(12) United States Patent
Chen et al.

(10) Patent No.: US 9,918,161 B1
(45) Date of Patent: Mar. 13, 2018

(54) SPEAKER BOX

(71) Applicants: Zhizhu Chen, Shenzhen (CN); Miao Miao, Shenzhen (CN); Fuhu Zhang, Shenzhen (CN); Chengliang Wang, Shenzhen (CN); Cheng Qian, Shenzhen (CN)

(72) Inventors: Zhizhu Chen, Shenzhen (CN); Miao Miao, Shenzhen (CN); Fuhu Zhang, Shenzhen (CN); Chengliang Wang, Shenzhen (CN); Cheng Qian, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/417,205

(22) Filed: Jan. 26, 2017

(30) Foreign Application Priority Data

Oct. 26, 2016 (CN) ..... 2016 2 1173672 U

(51) Int. Cl.
*H04R 1/02* (2006.01)
*H04R 1/28* (2006.01)

(52) U.S. Cl.
CPC ..... *H04R 1/2857* (2013.01); *H04R 1/023* (2013.01); *H04R 1/025* (2013.01); *H04R 1/2803* (2013.01); *H04R 1/2807* (2013.01); *H04R 1/288* (2013.01); *H04R 1/2873* (2013.01); *H04R 1/2876* (2013.01); *H04R 2499/11* (2013.01)

(58) Field of Classification Search
CPC ..... H04R 1/021; H04R 1/023; H04R 1/025; H04R 1/2803; H04R 1/2807; H04R 1/2811; H04R 1/2869; H04R 1/2873; H04R 1/2876; H04R 1/288; H04R 2499/11
USPC ..... 381/334, 337, 345, 346, 347, 349, 350, 381/351, 353, 354, 386; 181/146, 148, 181/149, 151, 156, 160, 198, 199
See application file for complete search history.

(56) References Cited

U.S. PATENT DOCUMENTS 9,838,765 B1 * 12/2017 Li ..... H04R 1/025
2007/0147645 A1 * 6/2007 Kuze ..... H04R 1/2819 381/337
2007/0286449 A1 * 12/2007 Matsumura ..... H04R 1/2803 381/433

* cited by examiner

*Primary Examiner* — Huyen D Le
(74) *Attorney, Agent, or Firm* — Na Xu; IPro, PLLC

(57) ABSTRACT

A speaker box is disclosed. The speaker box includes a housing; a speaker unit accommodated in the housing and including a diaphragm for generating sound; a front sound cavity cooperatively formed by the diaphragm and the housing; a sound channel communicating the front sound cavity with outside space of the speaker box; and a sound-absorbing device disposed in the sound channel. The sound-adsorbing device includes an accommodation housing, sound-absorbing powder filled in the accommodation housing and a separation net sealing the accommodation housing. The speaker box achieves designed acoustic parameters with good acoustic performance.

4 Claims, 3 Drawing Sheets

SPEAKER BOX

FIELD OF THE PRESENT DISCLOSURE

The present disclosure relates to the field of electro-acoustic transducers, and more particularly to a speaker box used in a portable electronic device.

DESCRIPTION OF RELATED ART

Among the existing technology, generally sound-absorbing cotton is attached on the sound channel of speaker box to improve the acoustic performance. However the size precision of sound-absorbing cotton is hard to meet the design demand in the actual application so that the speaker box cannot reach the designed acoustic parameters and the acoustic effect is badly affected.

Thereof, it is necessary to disclose and provide an improved speaker box to overcome the above-mentioned disadvantage.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
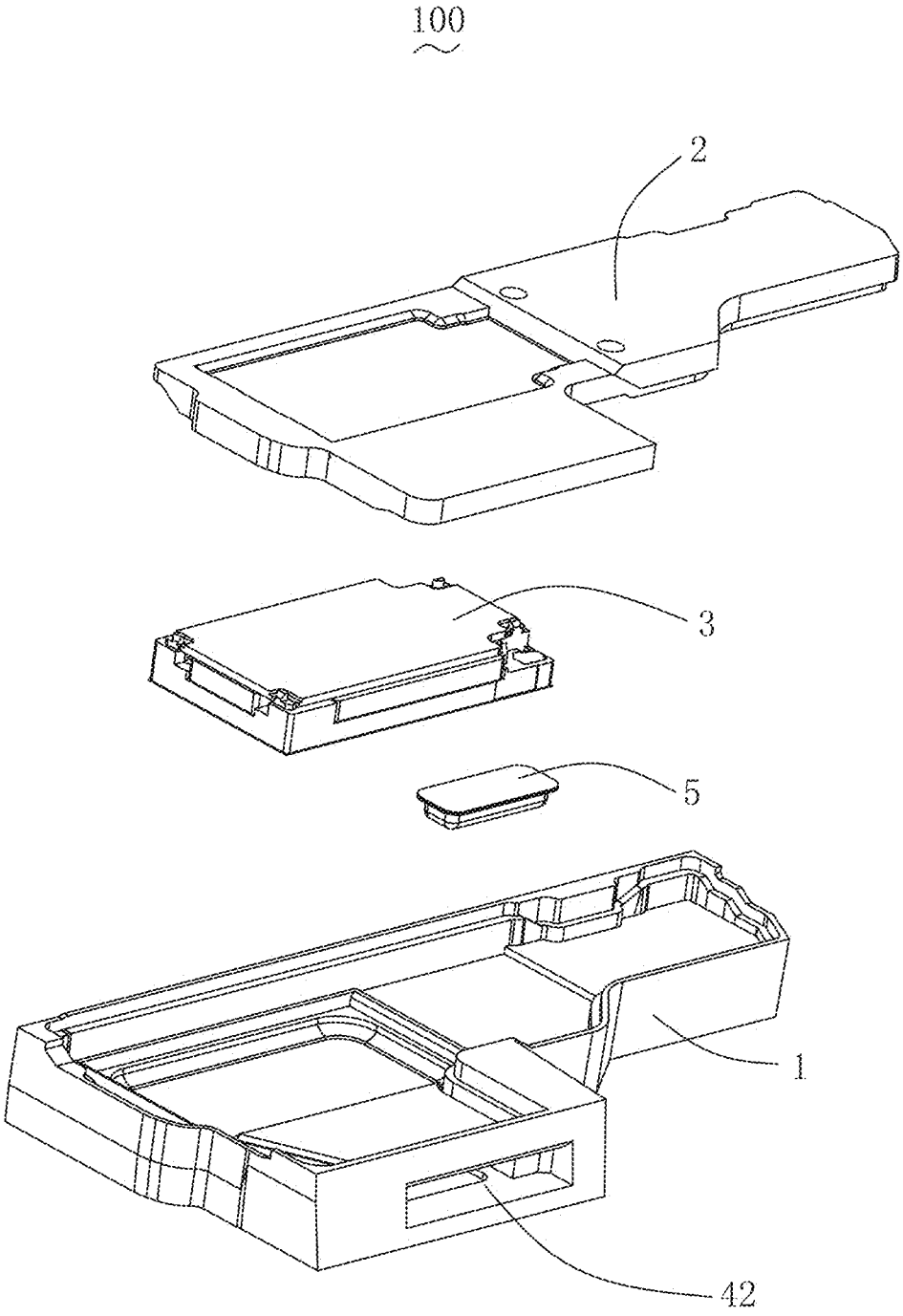
FIG. 1 is an isometric and exploded view of a speaker box in accordance with an exemplary embodiment of the present disclosure.
Figure 2:
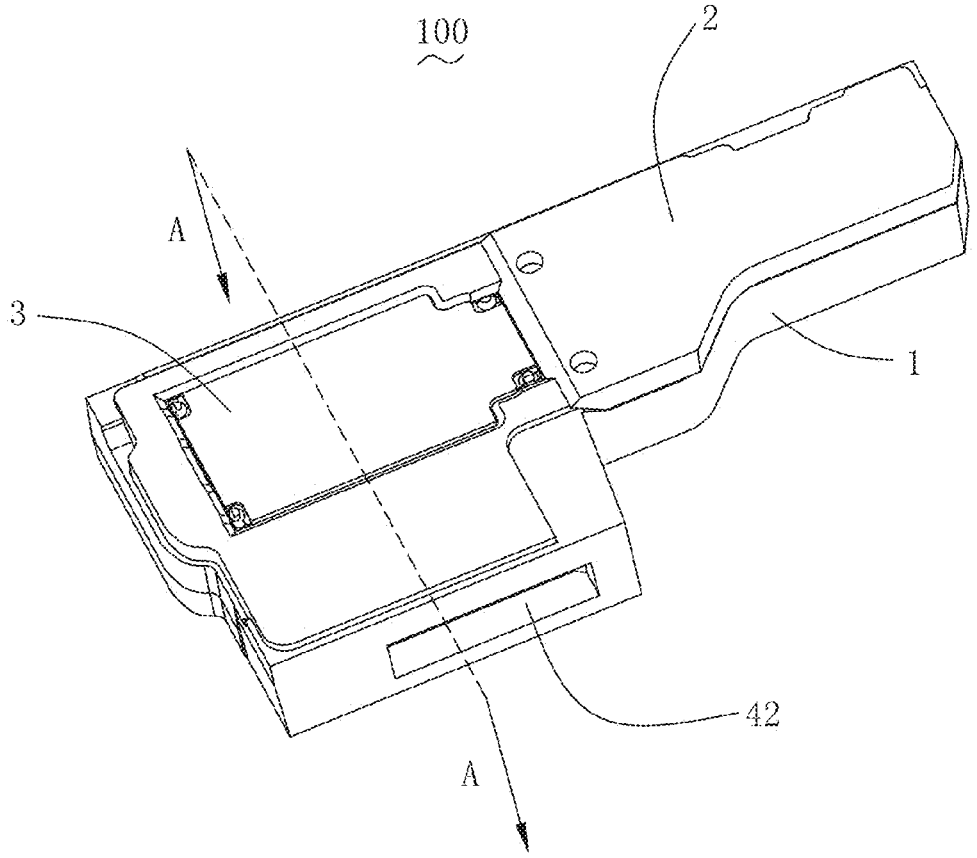
FIG. 2 is an isometric and assembled view of the speaker box in FIG. 1.
Figure 3:
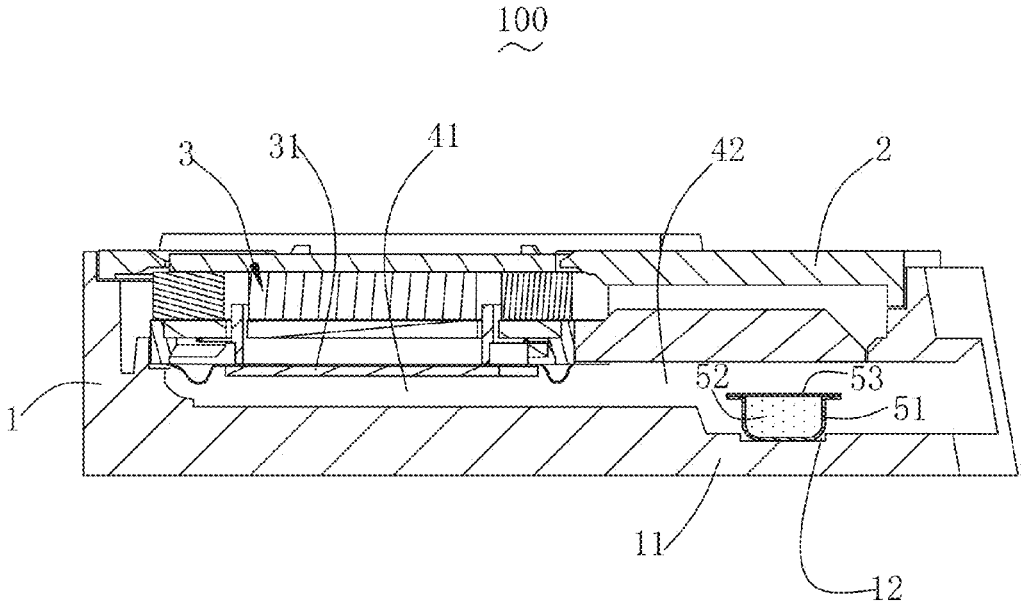
FIG. 3 is a cross-sectional view of the speaker box, taken along line A-A in FIG. 2.

Referring to FIGS. 1-3, a speaker box 100, in accordance with an exemplary embodiment of the present disclosure, includes a housing and a speaker unit 3. The housing includes an upper cover 1 and a lower cover 2 engaging with the upper cover 1, and the speaker unit is accommodated in the housing.

The speaker unit 3 includes a diaphragm 31 used for vibration to generate audible sound. The diaphragm 31 and the upper cover 1 cooperatively form a front sound cavity 41. The speaker box 100 further includes a sound channel 42 connecting the front sound cavity 41 with the outside. In this embodiment, the sound channel 42 is formed on the upper cover 1.

The speaker box 100 further includes a sound-absorbing device 5 disposed in the sound channel 42. The sound-absorbing device 5 includes an accommodation housing 51, sound-absorbing powder 52 filled in the accommodation housing 51, and a separation net 53 for sealing the accommodation housing 51. The separation net 53 seals the sound-absorbing powder 52 in the accommodation housing 51.

One of dust-proof cloth, dust-proof net cloth, nylon weaves and metal net can be chosen to be the separation net 53.

The accommodation housing 51 is formed by injecting and molding preferably polycarbonate plastics (PC plastics) or ABS (Acrylonitrile Butadiene Styrene copolymers) plastics. The strength of polycarbonate plastics and ABS plastics is high. The precision of size is high. The stability of size is good.

The separation net 53 is bound on the accommodation housing 51 by adopting hot-pressing way.

The upper cover 1 includes a housing wall 11 corresponding to the sound channel 42. A groove 12 is arranged on the housing wall 11. The accommodation housing 51 is disposed in the groove 12.

The sound-absorbing device is disposed in the sound channel of the speaker box 100. The sound-absorbing device includes the accommodation housing, sound-absorbing powder filled in the accommodation housing and the separation net sealing the accommodation housing. The separation net seals the sound-absorbing powder in the accommodation housing. The size precision of sound-absorbing device can be guaranteed, which solves the disadvantage of the current technology that size precision of sound absorbing cotton is hard to meet design demand. The speaker box can achieve designed acoustic parameters with good acoustic performance.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box including:

a housing;

a speaker unit accommodated in the housing, including a diaphragm for generating sound;

a front sound cavity cooperatively formed by the diaphragm and the housing;

a sound channel communicating the front sound cavity with outside space of the speaker box;

a sound-absorbing device disposed in the sound channel, including an accommodation housing, sound-absorbing powder filled in the accommodation housing and a separation net sealing the accommodation housing.

2. The speaker box as described in claim 1, wherein the separation net is selected from dust-proof cloth, dust-proof net cloth, nylon woven mesh and metal net.

3. The speaker box as described in claim 1, wherein the separation net is bound with the accommodation housing by hot-pressing.

4. The speaker box as described in claim 1, wherein the housing includes a housing wall corresponding to the sound channel, a groove is formed in the housing wall for accommodating the accommodation housing.

* * * * *